US005647432A

United States Patent [19]

Rexford et al.

[11] Patent Number: 5,647,432

[45] Date of Patent: Jul. 15, 1997

[54] CERAMIC FERRULE AND CERAMIC FERRULE REFRACTORY WALL FOR SHIELDING TUBE SHEET/BOILER TUBE ASSEMBLY OF HEAT EXCHANGER

[75] Inventors: Donald G. Rexford, Pettersonville; Jeffrey J. Bolebruch, Gloversville, both of N.Y.

[73] Assignee: Blasch Precision Ceramics, Inc., Albany, N.Y.

[21] Appl. No.: 630,473

[22] Filed: Apr. 10, 1996

[51] Int. Cl.[6] ..... F28F 19/00; F28F 9/02

[52] U.S. Cl. ..... 165/134.1; 165/82; 165/135; 165/158; 165/178

[58] Field of Search ..... 165/134.1, 180, 165/173, 158, 82, 178, 905, 135

[56] References Cited

U.S. PATENT DOCUMENTS

| | | | |
|---|---|---|---|
| 3,150,714 | 9/1964 | Jacobs et al. | 165/134.1 |
| 3,592,261 | 7/1971 | Black | 165/178 |
| 3,707,186 | 12/1972 | Zorrilla et al. | 165/134.1 |
| 3,739,840 | 6/1973 | Jones . | |
| 3,903,964 | 9/1975 | Van Doorn et al. | 165/158 |
| 4,176,612 | 12/1979 | Speer . | |
| 4,336,770 | 6/1982 | Kaneko et al. . | |
| 4,442,052 | 4/1984 | Reynertson . | |
| 4,585,057 | 4/1986 | Marburger | 165/134.1 |
| 4,622,921 | 11/1986 | Cameron et al. . | |
| 4,639,992 | 2/1987 | Stol et al. . | |
| 4,706,743 | 11/1987 | Chalimbaud | 165/134.1 |
| 4,750,553 | 6/1988 | Pohl et al. | 165/134.1 |
| 5,246,063 | 9/1993 | Fix et al. | 165/134.1 X |

FOREIGN PATENT DOCUMENTS

| | | | |
|---|---|---|---|
| 910528 | 6/1946 | France | 165/174 |
| 1248568 | 11/1960 | France | 165/178 |

OTHER PUBLICATIONS

Industrial Ceramics Limited catalog, Ceramic Boiler Protection Tubes, Date Unknown.

Drawing of Blasch Precision Ceramics' Hex Head Ferrule, Drawing No. 3090411, Apr., 1994.

*Primary Examiner*—Leonard R. Leo

*Attorney, Agent, or Firm*—Parkhurst, Wendel & Burr, L.L.P.

[57] ABSTRACT

A ceramic ferrule, an array of ceramic ferrules, and a ceramic ferrule refractory wall, all for shielding a tube sheet/boiler tube assembly of a heat exchanger connected to an industrial heat source. The head portion of each ferrule replaces conventional cast refractory walls, and has an outer-peripheral shape that allows the ferrules to mate at the operating temperature of the industrial heat source. The mated ferrules expand and contract substantially independently of one another, but form a substantially gas-tight barrier for shielding the tube sheet/boiler tube assembly from the waste gas of the industrial heat source.

29 Claims, 4 Drawing Sheets

CERAMIC FERRULE AND CERAMIC FERRULE REFRACTORY WALL FOR SHIELDING TUBE SHEET/BOILER TUBE ASSEMBLY OF HEAT EXCHANGER

BACKGROUND OF THE INVENTION

Waste heat boilers are commonly used with many types of industrial heat sources to extract heat from waste gases of an industrial process. It may be necessary to extract heat from the waste gas to cause a component thereof to condense, or it may be advantageous to extract heat from the waste gas and use that heat in another process or even to provide heat for the industrial facility.

Generally speaking, a waste heat boiler includes a plurality of metal boiler tubes supported by opposed metal tube sheets. The tube sheets define a vessel for holding water or some other form of heat transfer medium. Hot waste gas passes through the boiler tubes arranged in the inlet tube sheet and heat is extracted therefrom via heat transfer from the hot gas to the water contained within the confines of the tube sheets.

It is well known that it is necessary to shield the inlet ends of the boiler tubes from the heat and corrosive nature of the waste gas. It is therefore common to employ ceramic ferrules, such as those disclosed in U.S. Pat. No. 4,176,612, in the inlet ends of the boiler tubes. As shown in FIG. 1, a portion of each ceramic ferrule 10 extends out of the inlet face of each boiler tube 22. A castable refractory wall 30 is formed around the ferrules to hold the ferrules in place and to provide a heat shield for the inlet tube sheet 24. Thus, the ceramic ferrules and the castable refractory wall respectively shield the inlet ends of the boiler tubes 22 and the inlet tube sheet 24 from the waste gas.

There are several problems with this type of conventional ferrule/refractory wall system. First, it is extremely labor intensive to form the refractory wall 30 around the ferrules 10 extending out of the inlet tube sheet 24. Second, since the refractory wall 30 is typically several inches thick, its weight induces significant stresses on the ferrules 10, thus requiring that the thickness of the ferrule walls be relatively large. Larger ferrule wall thickness equates to lower throughput (i.e., lower open area and higher pressure drop) of waste gas through the waste heat boiler. Third, the refractory wall 30 and ferrules 10 become a monolithic body after the castable refractory sets. Such a large refractory body does not handle thermal cycling well and will crack after repeated heating/cooling cycles. The cracked refractory wall/ferrule body requires regular repair and replacement.

SUMMARY OF THE INVENTION

The present invention was developed in view of the above-discussed problems with the prior art.

An object of the present invention is to provide a ceramic ferrule for shielding a tube sheet/boiler tube assembly of a heat exchanger. The ceramic ferrule, a second end opposed to the first end, an inner surface defining a passageway extending from the first end to the second end, and an outer peripheral surface extending from the first end to the second end. The outer peripheral surface of the head portion has (i) an outer shape that allows mating of a plurality of the ferrules to form cooperatively a substantially gas-tight refractory barrier wall, (ii) a groove formed therein which extends around the circumference thereof. Insulating means is accommodated in the groove. The tube portion has a first end portion joined to the head portion, a second end defining the outlet of the ferrule, and an inner surface defining a passageway extending from the first end to the second end and merging with the passageway of the head portion.

With the ceramic ferrule of the present invention, there is no need for a castable refractory wall in addition to the ferrule, because the outer shape of the head portion of the ferrule allows mating of a plurality of the ferrules in an array to form cooperatively a substantially gas-tight refractory barrier wall. The outer peripheral dimension of each ferrule is selected such that the ferrules are separated from one another when the industrial heat source is inoperative, and are abutted/mated at respective outer peripheral surfaces when the industrial heat source is operative, whereby a substantially gas-tight seal is formed between the entirety of respective outer peripheral surfaces of adjacent ferrules. The head portions of the ferrules have sufficient axial length to perform the function of the castable refractory wall, that is, shield the inlet tube sheet from the waste gas. The tube portions of the ferrules shield the inlet ends of the boiler tubes, as in the prior art.

The ferrule of the present invention alleviates all the problems associated with the conventional ferrule/refractory wall system. Specifically, since the head portions of the array of mated ferrules shield the inlet tube sheet, it is not necessary to cast a separate refractory wall. Thus, the cost and labor associated with casting and maintaining/replacing the refractory wall is avoided.

Additionally, the radial thickness of the ferrule walls can be reduced, because there are no stresses induced therein by the weight of the castable wall. Smaller ferrule wall thickness equates to higher throughput (i.e., larger open area and lower pressure drop) of waste gas through the waste heat boiler.

Still further, since the outer peripheral surfaces of the array of ferrules mate to form a substantially gas-tight seal at the operating temperature of the industrial heat source, it is unnecessary to use bonding mortar between adjacent ferrules that would otherwise cause the array of ferrules to act like a monolithic cast refractory wall. Thermal cycling-induced cracking otherwise experienced in cast refractory walls is reduced substantially, since each ferrule can expand and contract substantially independently of adjacent ferrules.

DETAILED DESCRIPTION OF THE INVENTION

Figure 1:
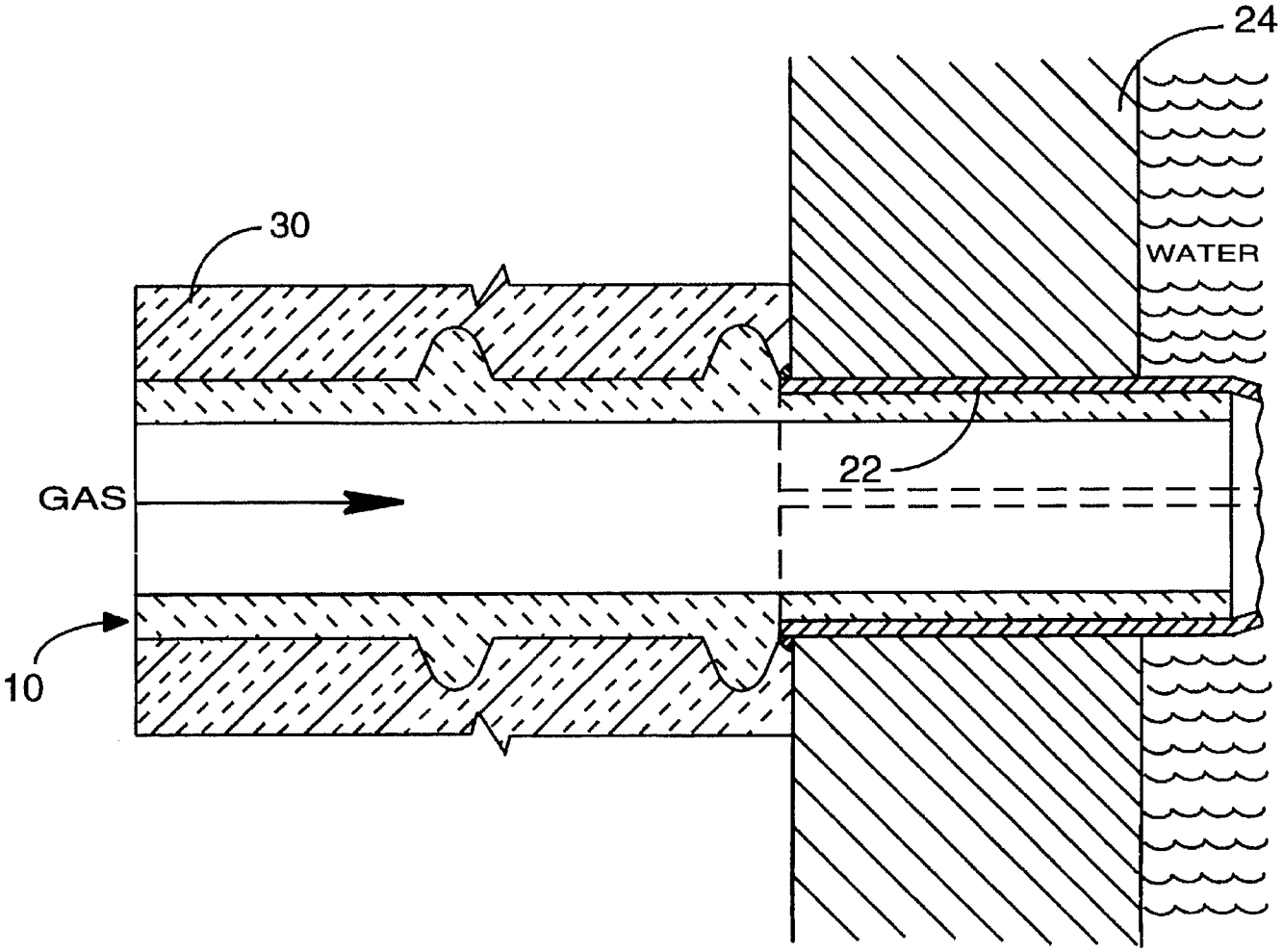
FIG. 1 PRIOR ART
FIG. 1 is a cross-sectional view of a refractory wall/ferrule system of the prior art.
Figure 2:
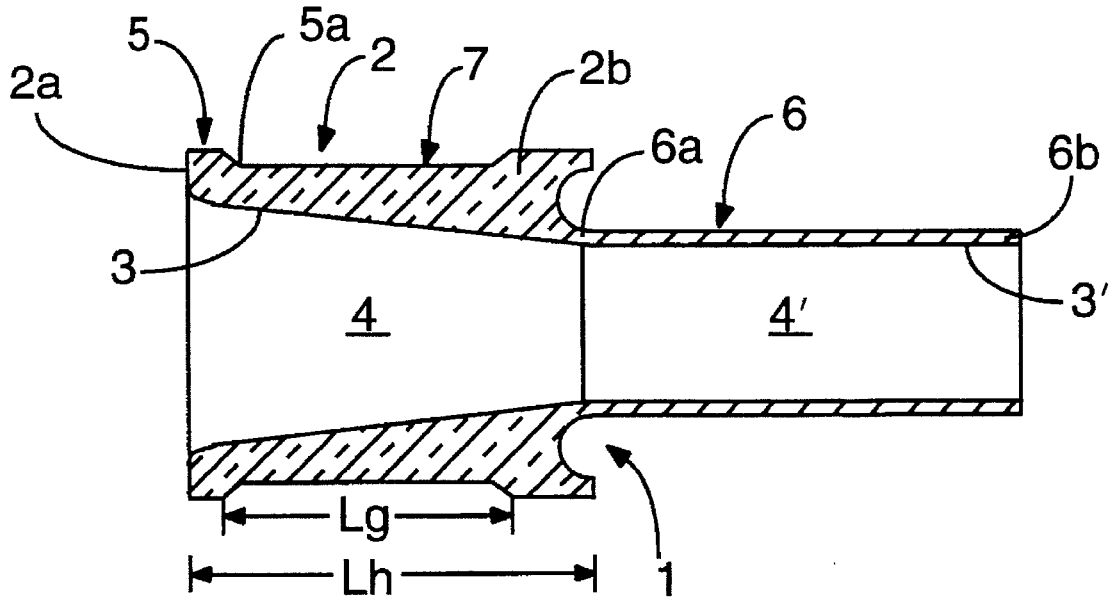
FIG. 2 is a longitudinal cross-sectional view of one embodiment of the ceramic ferrule of the present invention.

FIG. 2 is a cross-sectional view of one embodiment of the ceramic ferrule 1 of the present invention. The ferrule includes a head portion 2 and a tube portion 6. The ceramic ferrule is preferably formed as an integral unit, although head portion 2 and tube portion 6 can be formed separately and then bonded together with a suitable bonding agent.

The head portion 2 of ferrule 1 has a first end **2*a* defining an inlet of the ferrule, a second end 2*b*** opposed to first end 2a, an inner surface 3 defining a passageway extending from first end 2a to second end 2b, and an outer peripheral surface 5 extending from first end 2a to second end 2b. The tube portion 6 of ferrule 1 has a first end 6a joined to head portion 2, a second end 6b defining the outlet of the ferrule, and an inner surface 3' defining a passageway 4' extending from first end 6a to second end 6b and merging with passageway 4 of head portion 2.

The outer peripheral surface 5 of head portion 2 has an outer shape that allows mating of a plurality of the ferrules to form cooperatively a substantially gas-tight refractory barrier wall. The outer shape, when viewed in a transverse plane of the ferrule (FIG. 4A), can be polygonal (e.g., square or hexagonal). Square ferrule heads would be used with inlet tube sheets having boiler tubes arranged in square pitch, while hexagonal ferrule heads would be used with inlet tube sheets having boiler tubes arranged in triangular pitch.

FIG. 2 shows that head portion 2 includes a groove 7 formed in the outer peripheral surface thereof. Groove 7 preferably extends around the entire circumference of head portion 2, although partial circumferential grooves could be employed. Groove 7 has an axial length Lg equal to at least about 50%, preferably 75%, of the axial length Lh of head portion 2. An outer surface 5A of head portion 2 that defines a bottom of groove 7 preferably is substantially linear, when viewed in a longitudinal cross-sectional plane of the ferrule, such as in FIG. 2.

Groove 7 is designed to accommodate insulating means, such as alumina paper 8 (FIG. 3), which assists in providing a substantially gas-tight seal between adjacent ferrules, as explained below. The depth of groove 7 should be sufficient to accommodate the alumina paper 8 when compressed by adjacent ferrules, but not so deep as to threaten the structural integrity of the head portion.

Figure 3:
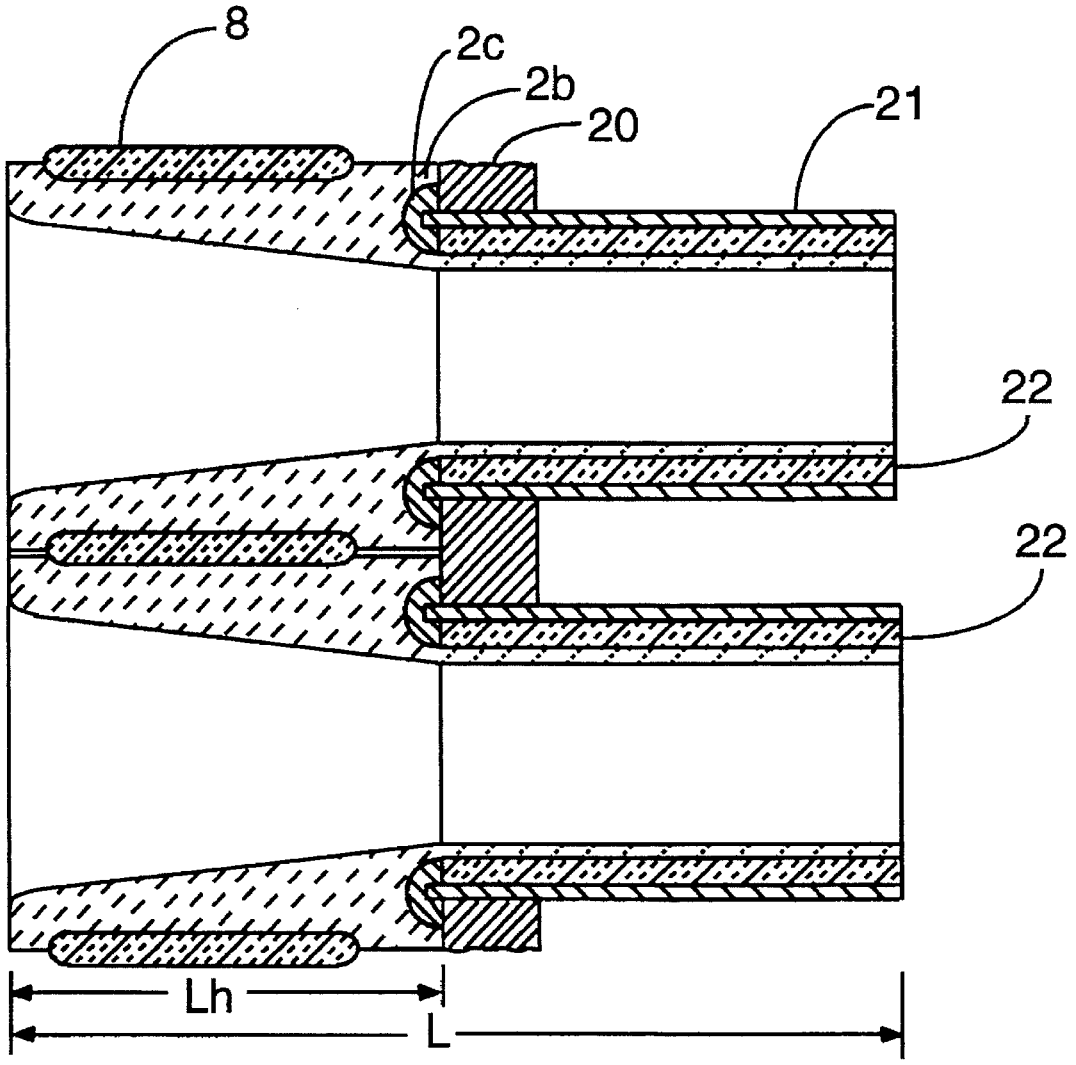
FIG. 3 a longitudinal cross-sectional view of two ceramic ferrules of FIG. 2 arranged in an inlet tube sheet.

FIG. 3 is a longitudinal cross-sectional view of two ferrules of FIG. 2 installed in an inlet tube sheet 20. Tube portion 6 of each ferrule 1 is inserted into the inlet end of each boiler tube 21. Preferably, a layer 22 of material such as FIBERFRAX™ is interposed between the outer periphery of tube portion 6 and the inner surface of boiler tube 21.

A portion of second end 2b of head portion 2 contacts the face of inlet tube sheet 20. A recess 2C can be provided in second end 2b to accommodate a weld seam between tube sheet 20 and boiler tube 21. The axial length Lh of head portion 2 is sufficient to shield the inlet tube sheet from the heat of the waste gas. Preferably, Lh is at least about ½ the overall axial length L of the ferrule.

Figure 4A:
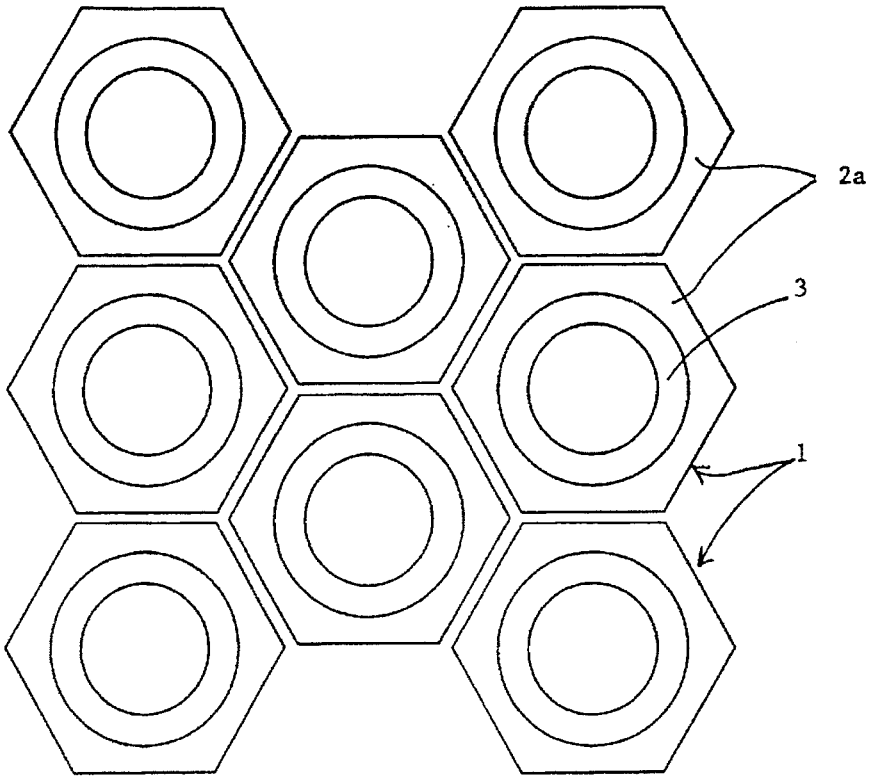
FIGS. 4A and 4B are plan views of an array of ceramic ferrules according to the invention at room temperature and at the working temperature of the industrial heat source, respectively.
Figure 4B:
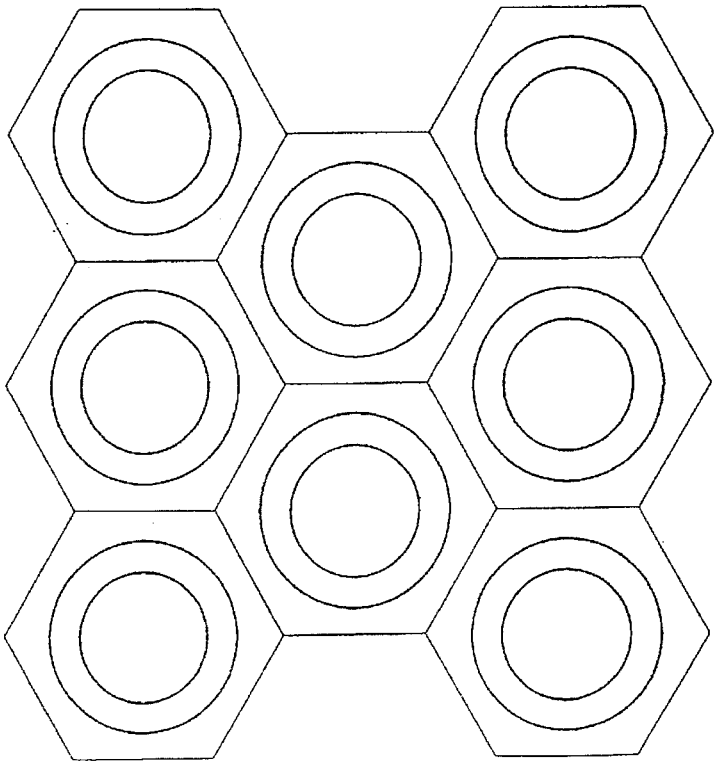

FIG. 4A is a plan view showing an array of ferrules 1 installed in boiler tubes of an inlet tube sheet. The boiler tubes and inlet tube sheet are hidden in FIG. 4A by the head and tube portions of the ferrules. The outer peripheral shapes of the ferrules shown in FIG. 4A are hexagonal, such that outer surfaces of adjacent ferrules will abut each other at the operating temperature of the industrial heat source. More specifically, the ferrules are dimensioned such that the outer peripheral surfaces thereof are spaced from one another when cold (i.e., when the industrial heat source is inoperative) (FIGS. 3 and 4A), and abut one another at the operating temperature of the industrial heat source (FIG. 4B). The mated ferrules act as a cast refractory wall by shielding the inlet tube sheet from the heat of the waste gas. The tube sheet is also protected from the corrosive nature of the waste gas, because the mated ferrules provide a substantially gas-tight barrier. The insulating means 8 provides additional security against gas leakage in the event that the outer peripheral surfaces of the ferrules do not come to full closure at the operating temperature of the heat source.

The ceramic ferrules of the present invention can be made of any type of refractory ceramic material. Examples include so-called high alumina (e.g., 95% by weight alumina) and alumina doped with silicon carbide (e.g., 85% by weight alumina and 10% by weight silicon carbide). As for the alumina paper 8, Altra® alumina paper, sold by Rath Performance Fibers, Inc., of Wilmington, Del., provides a good gas-tight seal between adjacent ferrules.

The ceramic ferrules can be made by any one of several conventional ceramic manufacturing processes, such as slip casting, injection molding, extrusion followed by machining, or the like. It is preferred that the ferrules are made according to the freeze cast process described in U.S. Pat. No. 4,246,209.

The outer shape of the head portions of the ferrules is determined by the pitch of the tube sheet, as explained above. The outer peripheral dimensions of the head portions are determined in the first instance by the spacing between the boiler tubes of the tube sheet. Based on those dimensions and (i) the material selected for the ferrules and (ii) the operating temperature of the industrial heat source, the "cold" outer dimensions of the ferrule head portions can be determined. It is elementary ceramic engineering to calculate the amount that the ferrules will expand from their room temperature, "cold" size to their operating temperature size (i.e., the expanded size of the ferrules at the operating temperature of the heat source), so that the spacing shown in FIG. 4A can be provided.

There should be enough spacing between the outer peripheral surfaces of the "cold" ferrules to allow the 'hot' ferrules to come to closure at the operating temperature of the heat source without inducing excessive stress between adjacent ferrules due to thermal expansion of each individual ferrule. For example, "high alumina" hex head ferrules as shown in FIGS. 4A and 4B having an outer dimension of 3.33" need a spacing of about 0.04" when installed, so that the ferrules will come to full closure when the industrial heat source reaches its operating temperature (e.g., 1500° C.).

In accordance with the invention, the array of ferrules defines a refractory wall that provides good protection for the tube sheet and inlet ends of the boiler tubes. At the operating temperature of the industrial heat source, the head portions of the ferrules come together and act as a single refractory mass to shield the inlet tube sheet and the inlet ends of the boiler tubes. However, since the ferrules are not mortared together, each ferrule can "float" in its respective boiler tube somewhat independent of adjacent ferrules. This ability to float alleviates stresses that may be present in the overall wall due to thermal expansion of individual ferrules. The elimination of such stresses provides a substantial improvement in the longevity of the ferrule wall. If the ferrules were mortared together, they would eventually fail (i.e., crack) as a result of thermal fatigue induced by repeated heating/cooling cycles.

The ability of each ferrule to float in its respective boiler tube also allows for compensation of any slight irregularities that may be present in the pitch arrangement of the tube sheet. More specifically, the alumina paper 8 provided in the outer groove 7 of each ferrule also provides somewhat of a cushion between adjacent ferrules to allow some latitude in positioning each ferrule in the overall ferrule refractory wall. The layer 22 between the outer surface of each ferrule tube 6 and each respective boiler tube 21 also acts as a cushion to assist in alignment of the ferrules in irregularly spaced/pitched boiler tubes.

By substituting the mated ferrule head portions for the cast refractory wall, it is possible to decrease the stress induced in the ferrules by the weight of the cast wall. Accordingly, it is possible to decrease the radial wall thickness of each ferrule. For example, in the ferrules shown in FIGS. 4A and 4B, the ratio of open area to overall frontal area of the ferrule inlet is about 70%. This large open area ratio allows for increased throughput of waste gas through the ferrules.

What is claimed is:

1. A ceramic ferrule for shielding a tube, sheet/boiler tube assembly of a heat exchanger comprising:

a head portion having a first end defining an inlet of the ferrule, a second end opposed to said first end, an inner surface defining a passageway extending from said first end to said second end, and an outer peripheral surface extending from said inlet first end to said second end, said outer peripheral surface having (i) an outer shape that allows mating of a plurality of said ferrules to form cooperatively a substantially gas-tight refractory barrier wall, and (ii) a groove formed therein which extends around the circumference thereof; and a tube portion having a first end joined to said head portion, a second end defining the outlet of the ferrule, and an inner surface defining a passageway extending from said first end to said outlet second end and merging with the passageway of said head portion.

2. The ceramic ferrule of claim 1, wherein the outer shape of said outer peripheral surface of said head portion is polygonal when viewed in a transverse plane of the ferrule.

3. The ceramic ferrule of claim 2, wherein said outer shape is hexagonal.

4. The ceramic ferrule of claim 1, wherein said groove extends around an entire circumference of said outer peripheral surface of said head portion.

5. The ceramic ferrule of claim 1, wherein said groove has an axial length equal to at least about 50% of an axial length of said head portion.

6. The ceramic ferrule of claim 1, wherein said groove has an axial length equal to at least about 75% of an axial length of said head portion.

7. The ceramic ferrule of claim 1, wherein an outer surface of said head portion that defines a bottom of said groove is substantially linear, when viewed in a longitudinal cross-sectional plane of the ferrule.

8. The ceramic ferrule of claim 1, wherein said ceramic ferrule comprises a refractory material.

9. The ceramic ferrule of claim 8, wherein said refractory material comprises alumina.

10. An array of ceramic ferrules for shielding a tube sheet/boiler tube assembly of a heat exchanger connected to an industrial heat source, each ceramic ferrule comprising:

a head portion having a first end defining an inlet of the ferrule, a second end opposed to said first end, an inner surface defining a passageway extending from said inlet first end to said second end, and an outer peripheral surface extending from said first end to said second end, said head portion having (i) an outer shape that allows mating of a plurality of said ferrules to form cooperatively a substantially gas-tight refractory barrier wall, and (ii) an axial length sufficient to shield the tube sheet from heat generated by the industrial heat source; and a tube portion having a first end joined to said head portion, a second end defining the outlet of the ferrule, and an inner surface defining a passageway extending from said first end to said outlet second end and merging with the passageway of said head portion;

wherein the outer peripheral dimension of each ferrule is selected such that the ferrules are separated from one another when the industrial heat source is inoperative, and are abutted at respective outer peripheral surfaces when the industrial heat source is operative, whereby a substantially gas-tight seal is formed between the entirety of respective outer peripheral surfaces of adjacent ferrules.

11. The array of ceramic ferrules of claim 10, wherein said outer shape of said outer peripheral surface of each ferrule is polygonal.

12. The array of ceramic ferrules of claim 10, wherein said outer shape of said outer peripheral surface of each ferrule is hexagonal.

13. The array of ceramic ferrules of claim 10, wherein said outer peripheral surface of each ferrule has a groove formed therein which extends around the circumference thereof.

14. The array of ceramic ferrules of claim 13, wherein said groove extends around an entire circumference of said outer peripheral surface of said head portion.

15. The array of ceramic ferrules of claim 13, wherein said groove has an axial length equal to at least about 50% of an axial length of said head portion.

16. The array of ceramic ferrules of claim 13, wherein said groove has an axial length equal to at least about 75% of an axial length of said head portion.

17. The array of ceramic ferrules of claim 13, wherein an outer surface of said head portion that defines a bottom of said groove is substantially linear, when viewed in a longitudinal cross-sectional plane of the ferrule.

18. The array of ceramic ferrules of claim 13, further comprising insulating means disposed in said groove of each ferrule for facilitating formation of said substantially gas-tight seal between respective outer peripheral surfaces of adjacent ferrules when the industrial heat source is operative.

19. The array of ceramic ferrules of claim 13, wherein said insulating means comprises alumina paper.

20. The ceramic ferrule of claim 10, wherein said ceramic ferrule comprises a refractory material.

21. The ceramic ferrule of claim 20, wherein said refractory material comprises alumina.

22. The refractory wall of claim 10, wherein an axial length of said head portion is about ½ an overall length of said ferrule.

23. A refractory wall for shielding a tube sheet/boiler tube assembly of a heat exchanger connected to an industrial heat source, wherein the tube sheet includes a plurality of openings for receiving the inlet ends of a corresponding plurality of boiler tubes, said refractory wall comprising:

a plurality of individual ceramic ferrules, each comprising a head portion adapted to cover the tube sheet and a tube portion adapted to extend into the boiler tube, said head portion having (i) an outer shape that allows mating of a plurality of said ferrules to form cooperatively a substantially gas-tight barrier wall, and (ii) an axial length sufficient to shield the tube sheet from heat generated by the industrial heat source, each said ferrule further comprising an outer peripheral surface having a groove formed therein which extends around the circumference thereof; and insulating means disposed in said groove of each ferrule for facilitating formation of said substantially gas-tight barrier wall;

wherein each said ferrule has an outer dimension that is selected (i) to provide a gap between outer peripheral surfaces of adjacent ferrule head portions when the industrial heat source is inoperative, and (ii) to cause outer peripheral surfaces of adjacent ferrule head portions to abut one another when the industrial heat source is operative.

24. The refractory wall of claim 23, wherein the outer shape of said head portion is polygonal.

25. The refractory wall of claim 23, wherein the outer shape of said head portion is hexagonal.

26. The refractory wall of claim 23, wherein an axial length of said head portion is about ½ an overall length of said ferrule.

27. The refractory wall of claim 23, wherein said insulating means comprises alumina paper.

28. The ceramic ferrule of claim 23, wherein each said ceramic ferrule comprises a refractory material.

29. The ceramic ferrule of claim 28, wherein said refractory material comprises alumina.

* * * * *